US011073150B2

(12) United States Patent
Haines

(10) Patent No.: US 11,073,150 B2
(45) Date of Patent: Jul. 27, 2021

(54) METHOD, SYSTEM, AND APPARATUS FOR TESTING PUMPS

(71) Applicant: Haines Fire & Risk Consulting, Southampton, NJ (US)

(72) Inventor: Stephen W. Haines, Little Egg Harbor, NJ (US)

(73) Assignee: Haines Fire & Risk Consulting, Southampton, NJ (US)

( * ) Notice: Subject to any disclaimer, the term of this patent is extended or adjusted under 35 U.S.C. 154(b) by 26 days.

(21) Appl. No.: 16/711,716

(22) Filed: Dec. 12, 2019

(65) Prior Publication Data

US 2020/0191140 A1 Jun. 18, 2020

Related U.S. Application Data

(60) Provisional application No. 62/778,429, filed on Dec. 12, 2018.

(51) Int. Cl.
*F04B 51/00* (2006.01)

(52) U.S. Cl.
CPC ..... *F04B 51/00* (2013.01)

(58) Field of Classification Search
CPC .... F04B 49/065; F04B 51/00; F04B 2205/07; F04B 2205/09; F04D 15/0088
See application file for complete search history.

(56) References Cited

U.S. PATENT DOCUMENTS 3,228,242 A * 1/1966 Williams ..... F04D 15/0088 73/168
3,942,375 A * 3/1976 Shepherd ..... F04B 51/00 73/168
4,782,696 A * 11/1988 Suchoza ..... F04D 15/0088 73/168
6,453,257 B1 * 9/2002 Juhasz ..... B01D 46/44 702/114
2005/0244280 A1 * 11/2005 Malone ..... H05K 7/20772 417/286
2007/0020108 A1 * 1/2007 Walls ..... F04B 49/022 417/44.2
2014/0249682 A1 * 9/2014 Cheng ..... F04D 15/0088 700/282
2015/0032271 A1 * 1/2015 Cheng ..... F04D 15/0066 700/282

(Continued)

*Primary Examiner* — David J Bolduc
(74) *Attorney, Agent, or Firm* — Maier & Maier, PLLC

(57) ABSTRACT

A method, system, and apparatus for testing mobile pumps and mobile fire pumps. Exemplary embodiments described herein can reduce or eliminate the discharge of water used for testing pumps to the ground or other ambient environments. Further, exemplary embodiments can reduce or eliminate the potential for contamination of water bodies and reduce or eliminate need for large transportable reservoirs as a source of water. Exemplary embodiments can include attachment of hose valves to pump outlets for controlling a flow rate of water as well as water pressure. A hose may further be coupled to each hose valve and looped to a pump inlet, allowing for the recycling of water. Flow meters may further be provided on the looped lines to measure water flow. A low flow capacity water source and discharge may be utilized to provide further control of or adjustment to test system temperature, water flow and pressure.

15 Claims, 3 Drawing Sheets

CONFIGURATION 1 - DISCHARGE FROM JUNCTION A

CONFIGURATION 2 - DISCHARGE FROM JUNCTION B

(56) References Cited

U.S. PATENT DOCUMENTS

| | | | | |
|---|---|---|---|---|
| 2017/0204866 | A1* | 7/2017 | Edmondson, Jr. | F04D 15/0066 |
| 2018/0003170 | A1* | 1/2018 | Ruger | F04B 23/04 |
| 2018/0004236 | A1* | 1/2018 | Feilcke | G05D 7/0688 |

* cited by examiner

CONFIGURATION 1 - DISCHARGE FROM JUNCTION A

CONFIGURATION 2 - DISCHARGE FROM JUNCTION B

METHOD, SYSTEM, AND APPARATUS FOR TESTING PUMPS

CROSS-REFERENCE TO RELATED APPLICATIONS

This application claims priority from U.S. Provisional Patent Application No. 62/778,429, filed on Dec. 12, 2018, entitled "METHOD, SYSTEM, AND APPARATUS FOR TESTING PUMPS," the content of which is hereby incorporated by reference in its entirety.

BACKGROUND

The performance of fire department pumps and mobile pumps used for fire protection, emergency water supply and other critical applications should be tested periodically in order to determine or validate that a pump and related equipment meets or exceeds original specifications and operates as intended. In the case of mobile fire apparatus and some emergency pumps, testing is required at least annually and following apparatus or pump repairs that may affect pump performance by local, municipal, state and/or federal law, as well as by insurers.

Accordingly, the National Fire Protection Association and other organizations have developed standards and guidelines addressing these requirements. Over the last twenty years, the rated flow capacity of municipal and industrial fire apparatus and mobile pump units has increased steadily to meet growing flow demands and dwindling emergency response resources. Currently it is common to have mobile pump capacities of 5000 to 8000 gallons per minute (gpm), as compared to 1000 to 1500 gpm in the past.

These higher capacity pumps have created difficulties and potential safety hazards that require different methods of testing. Previously, a typical performance test required the pump to draw water from a natural or man-made water source or a fixed or mobile fire hydrant system and the discharged water would be directed through hoses with calibrated nozzles to the ground or back to the water source. Discharging large amounts of water during testing, however, can pose a physical hazard to persons in the area, damage surrounding infrastructure and landscaping, and harm wildlife, vegetation, and aquatic life. Furthermore, the operation of fire apparatus and mobile pumps adjacent to natural bodies of water may result in contamination of the water body as a result of incidental and unplanned releases of fuels, lubricants, hydraulic fluids and/or fire suppression agents. In addition, test methods based on the use of pressurized water supplies should minimize water usage to reduce cost, reduce the impact on the system and other users, conserve potable water and to minimize the impact that chlorinated water may have on the environment. Further, pumps can overheat resulting in damage to internal parts if operated in a recirculating mode for extended periods without provision for controlling temperatures.

As a result, improved testing methods, systems and apparatus are needed for testing of fire apparatus and other mobile pumps.

SUMMARY

A method, system, and apparatus for testing pumps. Exemplary embodiments described herein can reduce or eliminate the discharge of water used for testing pumps to the ground or other ambient environments. Further, exemplary embodiments can reduce or eliminate the risks posed by operating fire apparatus and pumps near natural bodies of water and reduce or eliminate the need for large transportable reservoirs (or tank trailers) and high flow capacity sources of water.

Exemplary embodiments can include attachment of hose valves to pump outlets for controlling the flow rate of water as well as water pressure. A hose may further be coupled to each hose valve and looped to a pump inlet connection, allowing for the recycling of water. Flow meters may further be provided on the looped lines to measure water flow. Additionally, a water source and a water discharge outlet (with or without flow meters) capable of supporting only a fraction of the pump's rated flow capacity may be utilized to provide cooling of the pump test system and to provide further control of or adjustment to water flow and pressure on the inlet side of the pump.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Additionally, as used herein, the terms "measurement device", "flow measurement device" "flow meter" or "flow meter assemblies" can mean any instrument, device, or assembly thereof used to monitor, measure, or record the pressure and/or the rate of flow a liquid or volume of liquid flowed over time. Further, while water is utilized in many exemplary embodiments, it may be appreciated that other liquids may be utilized or substituted, as desired.

Figure 1:
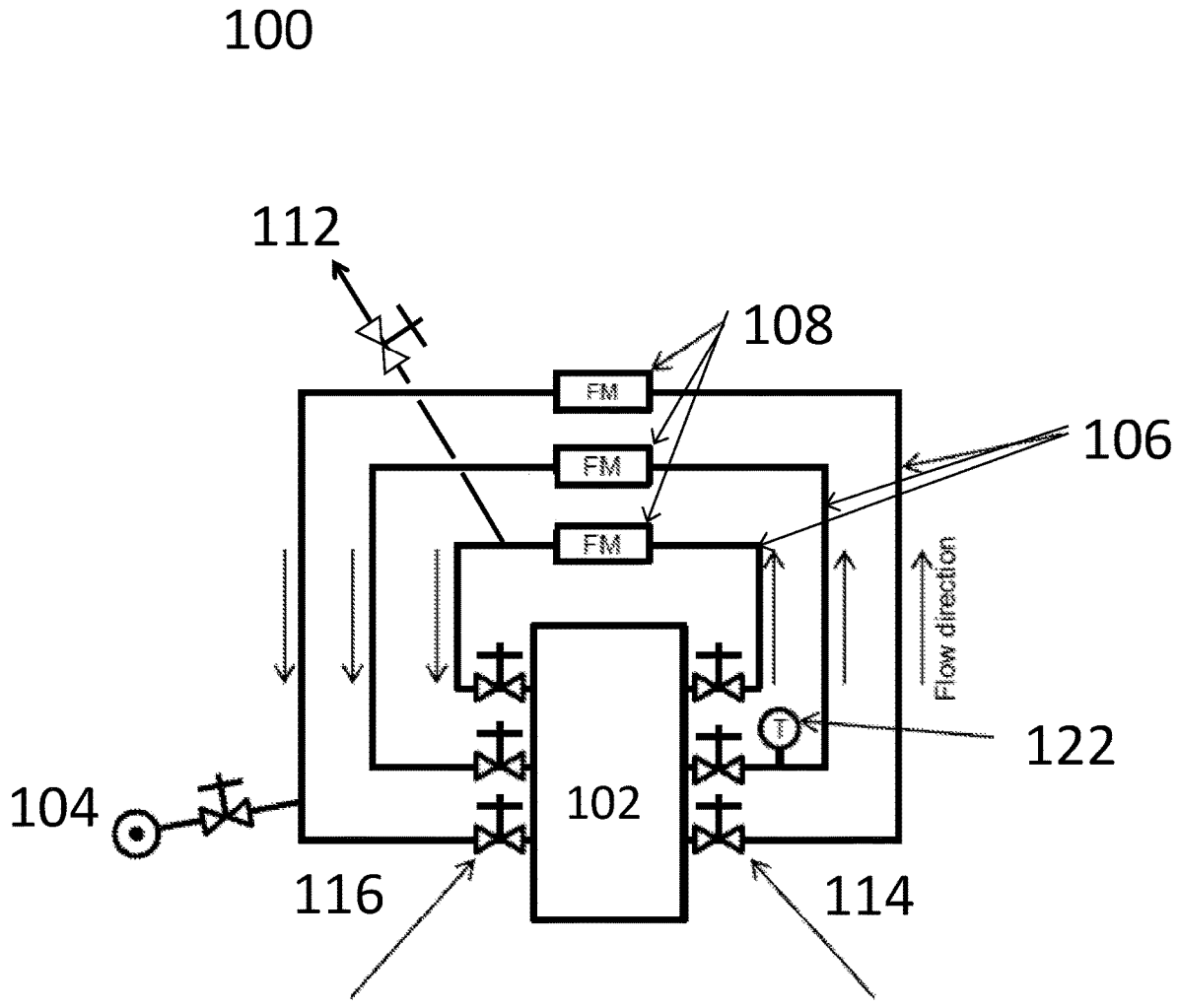
FIG. 1 is an exemplary view of elements of a pump testing system and apparatus.
Figure 2:
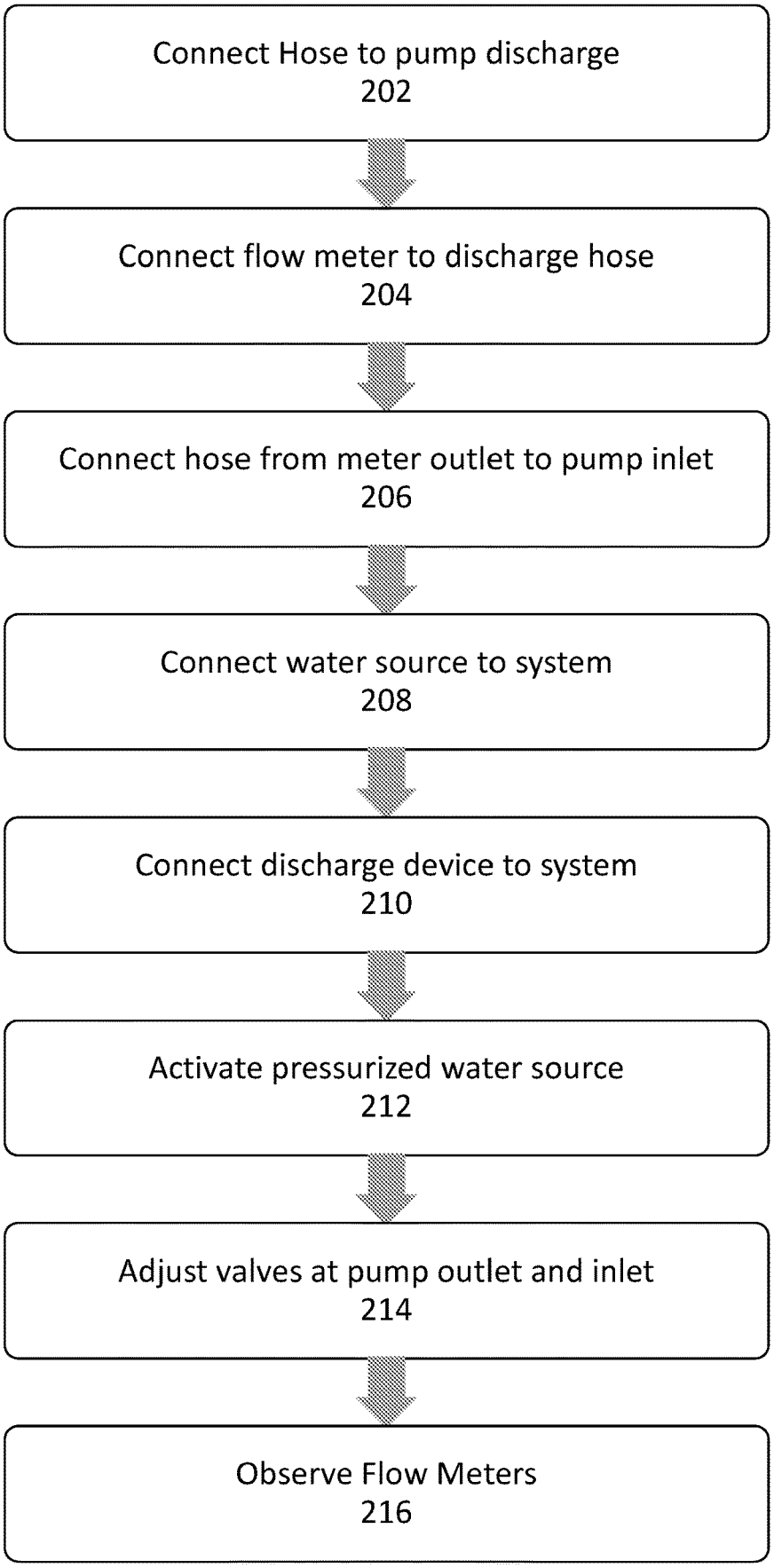
FIG. 2 is an exemplary method for testing pumps.
Figure 3:
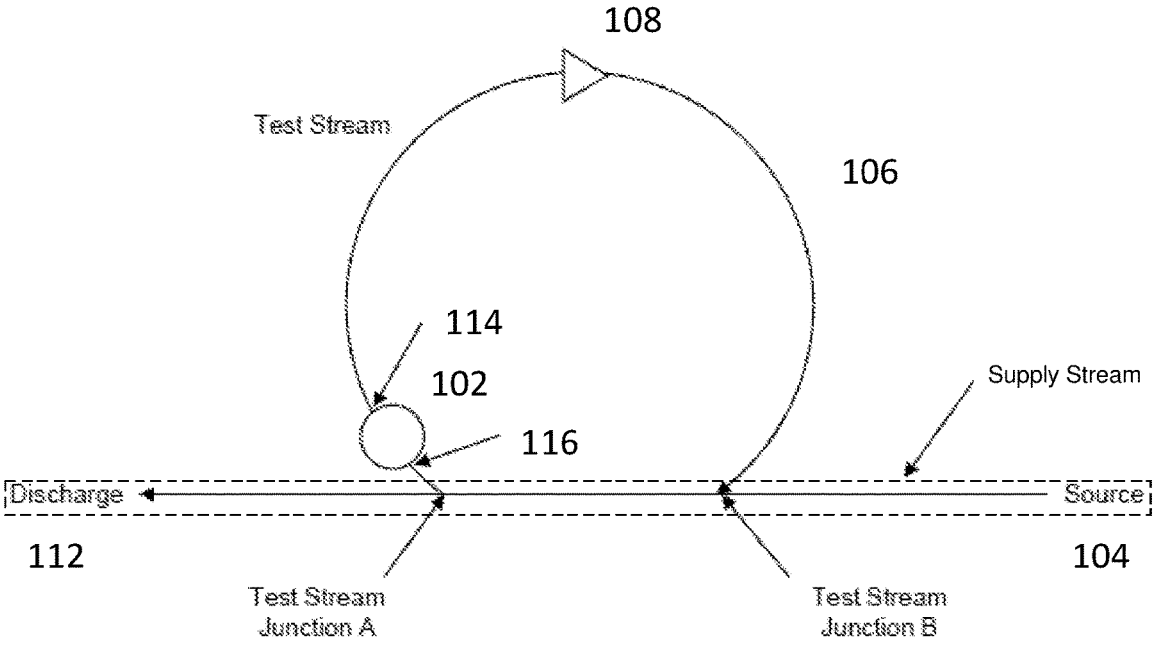
FIG. 3 is an exemplary flow diagram demonstrating two possible modes of operation.
Figure 3:
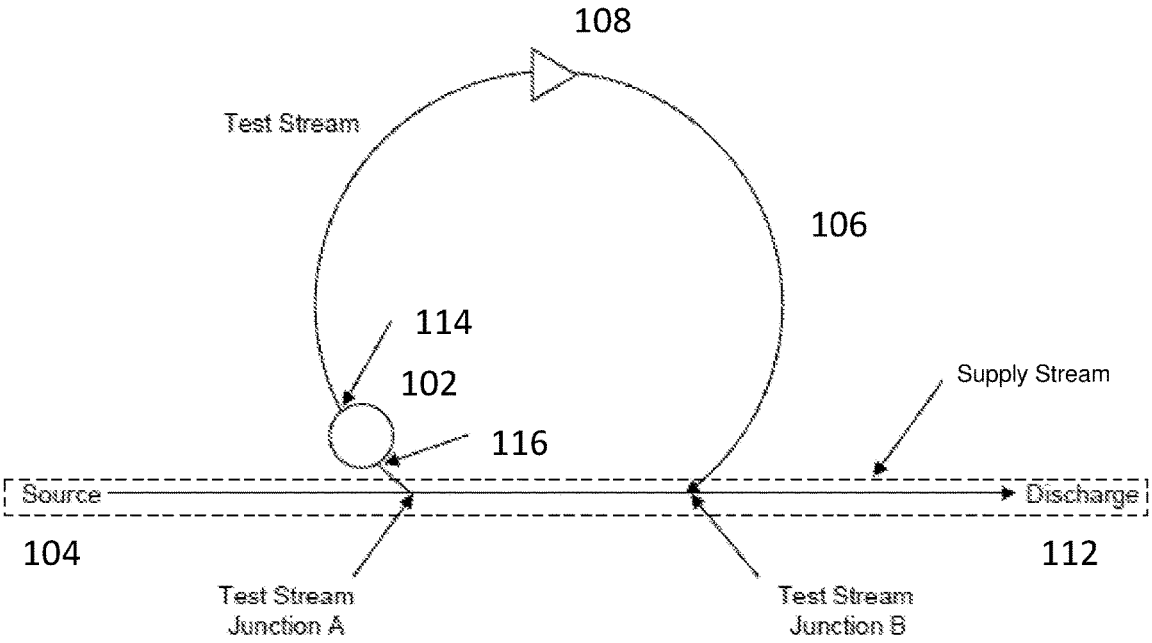

According to an exemplary embodiment, and referring generally to FIGS. 1-3, various exemplary embodiments of a method, system, and apparatus for pump testing may be shown and described.

Referring to the exemplary embodiment in FIG. 1, FIG. 1 may illustrate a pump testing system 100. The pump testing system 100 may include a variety of components. The components may be, but are not limited to, a pump 102 having an inlet 116, an outlet 114, a water supply 104, a variety of valves and devices for adjusting pressure and flow of water, a hose 106, a flow meter 108, and a water discharge 112. Multiple valves, hoses, flow meters, and pressure gauges may be integrated into the system, depending on the application.

It may be contemplated that configurations other than the configuration depicted in FIG. 1 may be utilized, as desired. In such an exemplary embodiment, however, one or more hose valves, along with any appropriate fittings or adapters, may be attached to pump outlets 114 for controlling the flow rate and/or net pressure developed by the pump. Other flow control devices known in the field may be used in place of valves. Valves may be used in series to provide multiple stages of pressure reduction, to improve measurement accuracy, and prevent damage. It may be appreciated that fittings or adaptors may be quick-connect or quick-release, threaded, or otherwise capable of securely coupling and releasing. Additionally, various configurations, sizes and quantities of valves, nozzles, fittings, and adaptors may be used, as desired. The configurations may depend on, for example, the pump rating or the need to obtain a desired pressure drop or flow rate, obtain an accurate flow measurement, or to prevent or mitigate wear or damage to various components, such as preventing cavitation, or the like.

In still further exemplary embodiments, a hose 106, such as a fire hose, may be connected to the pump outlet 114 or individual valves on a pump outlet manifold and may then be looped to the pump inlet 116 or individual valves on the pump inlet manifold. One or more additional valves, along with any appropriate or desired fittings or adapters, may further be installed or coupled at each end of or along the length of the hose 106 for controlling the flow rate and/or net pressure developed by the pump 102. Flow measurement devices, such as flow meter assemblies 108 may then be installed in or at ends of each of the looped lines formed by the hoses 106. Further, a flow measurement device 108 may or may not require an external power source. The flow measurement device 108 may be powered by water flowing through the system, or an internal power source, such as a battery.

In still further exemplary embodiments, the flow test capacity of the method can be infinitely and incrementally variable; within the minimum and maximum usable flow measurement capacities of the individual hose loops or flow meters. For example, using two loops may double the flow test capacity, using three loops may triple the flow test capacity, etc. The maximum flow test capacity may be limited primarily by the number of hose loops that can be connected to the pump. The available flow capacity of the water source need only be a fraction of the pump's rated flow capacity.

In still some further exemplary embodiments, various elements may be connected to unused pump inlets or to looped hose lines between flow meters and the pump inlets. For example, a hose line from a pressurized water source with a valve may be utilized to control the flow of water into the system or pressure at the inlet of the pump, including pressures below atmospheric pressure. Further, it may be appreciated that the water supply may be from a fixed water supply system, tank truck or vehicle, reservoir tank, small pump, or other natural or man-made water source, such as a pond. Additionally, a hose line, such as a hose may be connected to discharge 112 to expel water or air from the pump and hose system to provide cooling or control of pressure in the system, as desired. The discharge hose may additionally include a flow measurement device, valves, adaptors, or a pump. Further, a hose coupled to a source may be used to initially fill the pump and the looped hose system. Priming pumps or systems may be used to evacuate air and fill the test system or the source hose may push air out of the system via the discharge, for example before use, or may be utilized to purge or clear the system as otherwise appropriate. In an exemplary embodiment, a temperature gauge 122 may be included. The temperature gauge 122 may be placed at any location on the system 100, such as on the hose line 106.

Following activation of the pump, the water source 104 may be continuously or intermittently flowing into the pump test system. In still some further exemplary embodiments, the test method, system, and apparatus may be utilized in continuous, uninterrupted operation of the pump to be tested. The nature and construction of exemplary embodiments shown herein allow for continuous, longer duration operation without pump overheating. Further, test limits of exemplary embodiments described herein may only be limited by a duration of a pump's power, fuel supply and volume, flow capacity, and/or duration or availability of a water source.

In still further exemplary embodiments, the discharge 112 can be used to remove air and to discharge warm water from the system as well. Air venting can be accomplished during initial filling of the system with water and during operation of the system. Following activation of the pump warm water may be continuously or intermittently discharged from the pump test system.

In further exemplary embodiments, the system may be operated in a variety of manners. For example, a water source 104, which may be a standard fire hydrant, may be opened, and the valves on the test system may also be opened. Water may flow into the pump 102 and hoses 106, and any air in the system may be purged. The pump 102 may then be started, and the hydrant valve 104 can be throttled until an appropriate pump inlet pressure and discharge flow rate is established. The pump 102 can then be brought up to a desired operating speed or flow rate, as appropriate or desired.

The valves at the pump outlet 114 and inlet 116 may be adjusted to obtain a desired net pressure. The net pressure may be determined as pump outlet pressure minus pump inlet pressure ($P_{outlet}-P_{inlet}$). Flow readings may be taken once a desired net pressure has been obtained. This procedure can then be repeated at various flow rates and pressures. During such testing, the water source 104 and discharge 112 may be intermittently or continuously flowed. For example, depending on test conditions, adjustments to various elements of the system, test results, or the like, water may be flowed as desired.

Referring now to exemplary FIG. 2, FIG. 2 may illustrate a method for testing a pump. In a first exemplary step, one or more hoses may be connected to the outlet of the pump 202. The hose or hoses may be any type, such as a fire hose. In a next exemplary step, one or more flow meter assemblies may be connected to the discharge hoses 204. The flow meters may be any type of flow meter or flow measurement device and may be powered using an internal or external source, or alternatively may be powered by the flow of water. Flow meters may be connected in a variety of locations. In an exemplary embodiment with multiple hoses, each hose may be fitted with a flow meter or a single flow meter may be used where the hoses converge or diverge. In a next exemplary step, the outlet of the flow meter is connected to pump inlet using a hose 206. In the next exemplary step, a water source is connected to the system 208. The water source may be of any type, such as a fire hydrant, natural or man-made body of water, or a water pump. In a next exemplary step, a discharge device is connected to the system 210. The discharge device may allow air to discharge from the pump as water is pumped in, facilitating the testing of the pump. The discharge hose may also allow for water to be pumped out and may facilitate the user in obtaining a desired pump inlet pressure below atmospheric pressure. In a next exemplary step, the water source may be activated or opened to actuate the flow of water through the pump hoses, flow meters and discharge device 212. Finally, the flow meters may be observed 214 in order to analyze the effectiveness of the pump. The flow meters may directly indicate readings or may alternatively send the flow data to an external device, such as a smartphone or personal computer. Additionally, the pressure may be adjusted at the valves connected to the pump, inlet/liquid source or discharge hose/device, and the flow meters may be observed again 214. Multiple readings may be taken corresponding to multiple different pressures. Pressure and/or flow rate may be measured at the inlets or outlets of the pump, the discharge, the inlet/liquid source, or at any other point.

In an exemplary configuration, and as illustrated in FIG. 3, the pump testing system may incorporate a supply stream and a test stream. The supply stream may start at one or more water sources 104 and may end at one or more discharges 112. In practice, the supply stream may consist of a single stream or multiple streams which converge and diverge upstream or downstream of test stream junction A. The flow through the supply stream may be regulated to obtain and maintain a desired pressure or vacuum at the pump inlet 116 and a desired flow rate at the discharge 112. A flow control device, such as a valve, may be used to control the flow and pressure through the system. The flow control device may include any possible device which can induce pressure loss to control flow/pressure and to connect the streams, such as a valve and the like. The flow rate at the discharge 112 and source 104 may be approximately equal. The system may be configured in various way, as shown in FIG. 3, to accommodate the space, layout and other conditions at the testing location. For example, the flow direction of the test stream and the flow direction of the source stream may be parallel as shown by Configuration 1 (where both streams flow in the same direction), opposing as shown in Configuration 2. Alternately, Junctions A and B can be located at a common point resulting in a cross-flow configuration.

The net pressure or pressure differential across the supply stream may be independent of the flow rate and net pump pressure in the test stream. The source 104 may be from any water supply or combination of supplies sufficient to sustain the desired flow rate at the discharge 112 and sufficient absolute pressure at the pump inlet 116. The discharge 112 may be to the atmosphere or any environment/system having a pressure less than that required at test stream junction A. The inlet manifold of the pump, where so provided, may be utilized as part of the supply stream and/or test stream.

The test stream starts at the pump inlet 116, gains power from the pump 102, exits the pump through the pump outlet 114, passes through flow measurement devices 108, enters the supply stream at test stream Junction B, exits the supply stream at the test stream Junction A and then returns to the pump inlet 116. The test stream may be split into multiple, parallel flow paths at any point downstream of the pump outlet and then rejoined at Test Stream Junction A or between test stream Junctions A and B. Flow measurement may be made at a common point or across each parallel flow path. The test stream is regulated to obtain and maintain the desired flow rates through the pump 102 and desired net pressures (pump outlet pressure minus pump inlet pressure) across the pump 102 to be tested. The flowrate through the test stream is controlled independent of the flow rate at the discharge of the supply stream. The flow rate and net pressure across the pump 102 is independent of the pressure at test stream junctions A and B. The pump outlet manifold, where so provided, may be utilized as part of the test stream.

The system may further be utilized to achieve test results under various pressure requirements depending upon the selection of the hose and other components utilized and the configuration of the liquid source and discharge of the supply stream. This includes situations where the pump inlet pressure is to be maintained above atmospheric pressure and above the pressure of the system or environment that the discharge expels the water into, the pump inlet pressure is to be maintained above atmospheric pressure and at or below the pressure of the system or environment that the discharge expels the water into, and the pump inlet pressure is to be maintained below atmospheric pressure regardless of the pressure of the system or environment that the discharge expels the water into.

In the above exemplary configurations and operation, a variety of desired outcomes may be achieved. Embodiments of the pump testing system may utilize significantly less water (in terms of both flow rate and total volume consumed) than traditional testing systems and methods due to the closed loop and recirculating nature of the embodiments. Further, negative environmental aspects of traditional pump testing methods and systems may be avoided as significantly less water is used than traditional methods and, following the completion of a test, there is significantly less water exiting the system to the ambient environment or a storage tank. Further, the use and size of tanker trailers is significantly reduced or eliminated due to the decreased need for larger amounts of water for such tests, so smaller trucks or trailers may be used to transport water to the testing location. Additionally, water used in the system can be flowed and measured at improved rates and water temperature can be more closely controlled. Wear and tear on physical elements of the system can further be reduced. Additionally, exemplary embodiments described herein can be made and operated at a significant cost savings when compared to traditional systems.

In some further exemplary embodiments described herein, it is envisioned that data obtained by the embodiments may be transmitted, in a wired or wireless fashion, and stored on an electronic device, such as a computer, tablet, smart phone, or other electronic device having a display, either located on or with the elements of the system or remotely. Further, it is envisioned that any element described herein could be controlled directly through mechanical actuation, electro-mechanical actuation, or via computer controls, either wired or wirelessly.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A system for testing pumps using one or more pressurized or non-pressurized liquid sources, comprising:

a pump to be tested that is connected to a test stream and supply stream; wherein the pump is comprised of an inlet and an outlet;

wherein the supply stream comprises one or more flow paths that draw from one or more liquid sources and terminates at one or more discharges, and further comprises:

one or more flow control devices configured to manage a pressure and a flow rate through the supply stream, and wherein the supply stream is connected to the test stream;

wherein the flow rate and pressure through the supply stream is regulated by the flow control devices to obtain and maintain an absolute pressure at the pump inlet and at a junction of the test stream and a junction of the supply stream;

wherein a flow rate at the discharge and a flow rate at the liquid source are approximately the same;

wherein a net pressure across the supply stream (the difference between the pressure at the liquid source(s) and at the discharge(s)) is independent of a flow rate and a pressure in the test stream;

wherein the test stream originates at the pump inlet, receives power from the pump, passes through the pump outlet, joins the supply stream, exits the supply stream and then returns to the pump inlet, and wherein the test stream comprises:

one or more flow control devices for managing a pressure and a flow rate between the pump inlet and outlet;

one or more flow paths;

a temperature, a pressure and a flow rate;

wherein the test stream joins and separates from the supply stream at one or more points, and a flow direction of the test stream relative to a flow direction of the supply stream is one of a cross flow, parallel flow in the same direction or an opposing flow;

wherein the flow rate and pressure drop through the test stream is regulated to obtain and maintain a flow rate and a net pressure across the pump to be tested, the net pressure being a pressure at the pump outlet minus a pressure at the pump inlet, wherein the flowrate through the test stream is controlled independent of the flow rate at the liquid source and discharge of the supply stream, and wherein the flowrate across the pump to be tested is independent of the flowrate at the liquid source and discharge of the supply stream.

2. The system of claim 1, further comprising a plurality of measurement devices configured to measure one or more of the flow rate, discharge pressure, suction pressure, inlet pressure, outlet pressure, pressure of the test stream pressure of the source stream and net pressure across the pump.

3. The system of claim 1, wherein the liquid source is continuously or intermittently activated.

4. The system of claim 2, wherein the measurement devices send data to an external device.

5. The system of claim 1, wherein a portion of the supply stream further comprises a plurality of permanent inlet manifolds, piping, and a plurality of waterways of the pump.

6. The system of claim 1, wherein a portion of the test stream further comprises a plurality of permanent outlet manifolds, piping, and a plurality of waterways of the pump.

7. The system of claim 1, wherein the liquid source is one or more of the set containing: fire hydrants, a fixed outlet on a piping system, a temporary outlet on a piping system, and a pump.

8. The system of claim 1, wherein the liquid source is a natural or man-made body of water, wherein the body of water is at, above, or below the elevation of the pump, and wherein the air space above the body of water is at, above or below atmospheric pressure.

9. The system of claim 7, further comprising a pump configured to retrieve and pressurize water from the body of water.

10. The system of claim 1, wherein the supply stream is configured in a recirculating loop with cooling of the liquid by one or more of the group comprising: a liquid-to-liquid heat exchanger, a liquid-to-air heat exchanger, refrigeration, and mixing with cooler water in piping, mixers, tanks and man-made or natural bodies of water.

11. The system of claim 1, wherein the system may be used with water or other liquids.

12. The system of claim 1, wherein the pump to be tested further comprises an inlet manifold and an outlet manifold configured to draw from a plurality of inlet connections and discharge through a plurality of outlet connections.

13. The system of claim 1, wherein the discharge expels the liquid to a system or environment having a pressure less than that required at the pump inlet.

14. The system of claim 1, wherein the discharge expels the liquid to a system or environment having a pressure greater than or equal to that required at the pump inlet.

15. The system of claim 1, wherein the pump inlet pressure is to be below atmospheric pressure, regardless of the pressure of the environment or system into which the liquid is expelled at the discharge.

* * * * *